United States Patent [19]

Gawlick et al.

[11] 3,967,555

[45] July 6, 1976

[54] PIEZOELECTRIC FUZE, ESPECIALLY FOR PROJECTILES

[75] Inventors: Heinz Gawlick, Furth, Bavaria; Uwe Brede, Schwaig, both of Germany

[73] Assignee: Dynamit Nobel Aktiengesellschaft, Germany

[22] Filed: Mar. 15, 1974

[21] Appl. No.: 451,675

[30] Foreign Application Priority Data

Mar. 15, 1973 Germany ..... 2312793

[52] U.S. Cl. ..... 102/70.2 GA; 102/70.2 R

[51] Int. Cl.[2] ..... F42C 11/02

[58] Field of Search ..... 102/70.2 GA, 70.2 R

[56] References Cited

UNITED STATES PATENTS

| | | | |
|---|---|---|---|
| 2,764,091 | 9/1956 | Hudson et al. | 102/70.2 GA |
| 3,196,794 | 7/1965 | Meade | 102/70.2 GA |
| 3,337,758 | 8/1967 | Brothers | 102/70.2 GA |
| 3,340,811 | 9/1967 | Gauld | 102/70.2 GA |
| 3,359,904 | 12/1967 | Nerheim | 102/70.2 GA |

*Primary Examiner*—Charles T. Jordan

*Attorney, Agent, or Firm*—Craig & Antonelli

[57] ABSTRACT

A piezoelectric fuze, especially for projectiles, having a piezoelectric element which converts the mechanical shockwave produced upon impact on a target into an output signal for igniting a detonator. A control circuit is provided for generating an output signal and a threshold switching circuit is provided for receiving the outputs of the control circuit and the piezoelectric element as a superimposed signal for establishing a connection between a power source and a detonator of the fuze when the threshold value of the threshold circuit is exceeded.

22 Claims, 5 Drawing Figures

FIG. 3
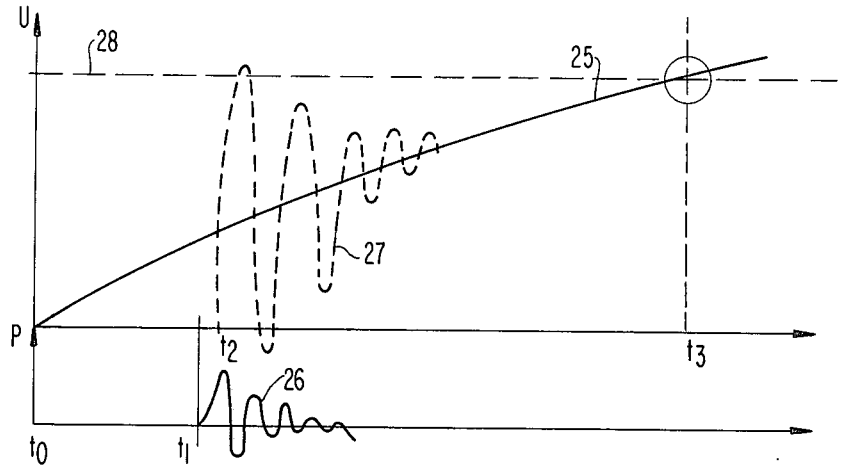
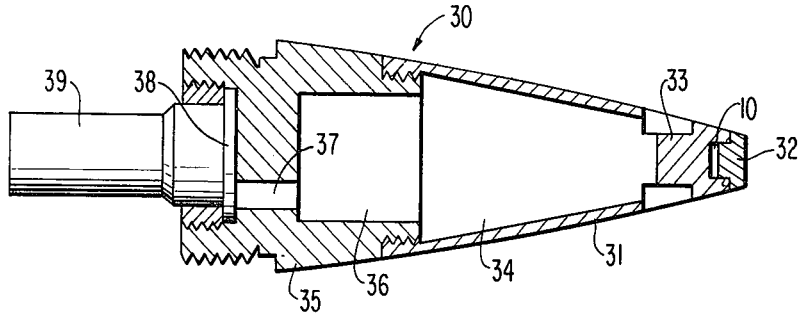
FIG. 4
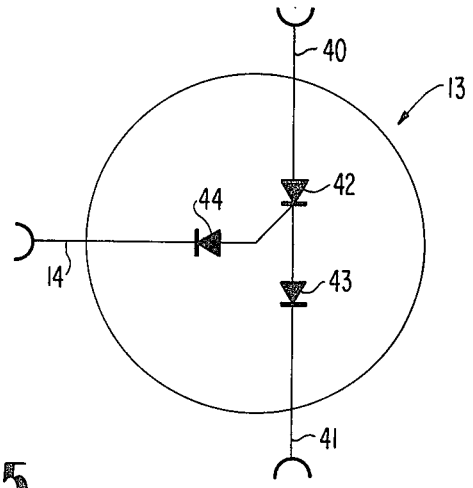
FIG. 5

PIEZOELECTRIC FUZE, ESPECIALLY FOR PROJECTILES

The present invention relates to a piezoelectric fuze, especially for projectiles, with a piezeoelectric element which converts the mechanical shock wave produced upon impact on a target into an electric voltage and ignites a detonator via a threshold circuit.

It is conventional to use, in a percussion fuze, a piezoelectric element which converts a portion of the mechanical impact energy produced upon impingement on the target into an electric voltage. This voltage is transmitted by way of a semiconductor component with trigger or threshold characteristics to the detonator, in order to ignite the latter. The semiconductor or component prevents the triggering of the detonation already in case of minor shocks and vibrations. Such fuzes operate without additional electric energy sources with the entire energy necessary to initiate the detonation process being provided by the piezoelectric element upon impact.

In such detonators, it is not readily possible to provide detonation blocking means which prevent the triggering of the detonation if a shock is effective on the piezoelectric element within a certain time period during which a detonation must be avoided under all circumstances. Furthermore, when the fuze is installed in a projectile, no arming operations can be provided during the flight of the projectile after leaving a safety zone upon firing. It can be advantageous in certain cases to effect ignition after a certain flight time of the projectile, if the projectile has not impacted on a target during this time, or if the piezoelectric element has not responded. If these functions were to be accomplished in the known piezoelectric fuze, two separate electric circuits would have to be provided. However, this is impossible in most cases due to space limitations, since in shell fuzes of smaller calibers up to 40 mm., there is only very little space for the entire fuze.

The invention is based on the problem of providing a piezoelectric fuze wherein special conditions for the actuation of the detonator can be set, so that safety against unintended ignition is increased but, in certain cases, an ignition can also be effected without there having been a response by the piezoelectric element.

In order to solve this problem, it is suggested according to this invention to provide that the detonator can be connected with a source of electric current by way of a switch which can be activated or blocked by the piezoelectric element and by at least one further functional group.

The detonator is actuated in this arrangement with respect to energization by the electric energy source. The function of the piezoelectric element is limited to controlling the switch. In addition to the piezoelectric element, the functional groups are effective on the switch. One of these functional groups can, for example, initiate the self-disintegration of the projectile, if the fuze has not been ignited within a certain time period after firing or, for example in case of a hand grenade, the fuze has not been ignited after the manual activation of a detonation trigger.

Furthermore, a functional group can be provided to ensure that the projectile is still in the safety position immediately after leaving the barrel, and/or another functional group can be arranged to effect a delay in penetration. These functional groups are timing members which prevent the transmission of the electric energy from the current source to the detonator during certain time periods. The structure of these functional groups, however, is not the subject of the present invention.

In order to effect a self-disintegration of the projectile after a predetermined, settable time period, and advantageous embodiment of this invention provides that the voltage of the piezoelectric element is superimposed on the voltage of a first functional group which builds up gradually or with a time delay. The piezoelectric element and the first functional group are connected to the control input of a threshold value or trigger switch member which connects the current source with the detonator with the switching threshold of the trigger switch member being dimensioned so that this threshold is exceeded by the voltage of the piezoelectric element only when superimposed by the voltage of the first functional group.

The superposition of the voltage of the piezoelectric element with that of the first functional group makes it possible to prevent, during the initial time period after activation of the current source, the disintegration of the projectile, even if a mechanical shock is effective on the piezoelectric element, because the electric energy of the piezoelectric element alone is insufficient to overcome the switching threshold. The voltage of the first functional group builds up in dependence on the time and supports the voltage of the piezoelectric element. The sum total of both voltages, after the predetermined safety period has elapsed, is capable of exceeding the switching threshold and initiating the ignition.

If the feature is included that the voltage of the first functional group finally rises to such an extent that it reaches the threshold voltage of the trigger switch member, a self-disintegration characteristic of the projectile is obtained, because the disintegration takes place, independently of any shock effect on the piezoelectric element, at the latest when the circuit of the first functional group has reached the threshold value.

The first functional group can be produced relatively simply from an RC circuit, the output of which is connected to the piezoelectric element and to the control input of the trigger. A delay circuit consisting of a resistor and a capacitor, which can be connected with the current source, is sufficient. The time after which the self-disintegration takes place begins with the connection of the RC member to the current source. This initiation can be accomplished by a contactor or closing switch which closes automatically upon firing of the projectile, for example an acceleration switch.

With respect to its construction, the fuze of the present invention is arranged advantageously so that the piezoelectric element is installed fixedly in the tip of a detonator head provided at the front of the projectile, and that the electronic components of the functional groups and switches are arranged behind the piezoelectric element, separated from the latter by a wall. The current source is preferably disposed behind the electronic components of the functional groups and the switches.

These and other objects, features and advantages of the present invention will become more apparent from the following description when taken in connection with the accompanying drawing, and wherein:

FIG. 3 shows the electric voltage curves and the curve of the mechanical deformation wave after the firing of a projectile and after impingement on the target, respectively;

FIG. 4 shows a fuze construction in accordance with the present invention; and

FIG. 5 shows an equivalent circuit diagram for the threshold value switch.

Figure 1:
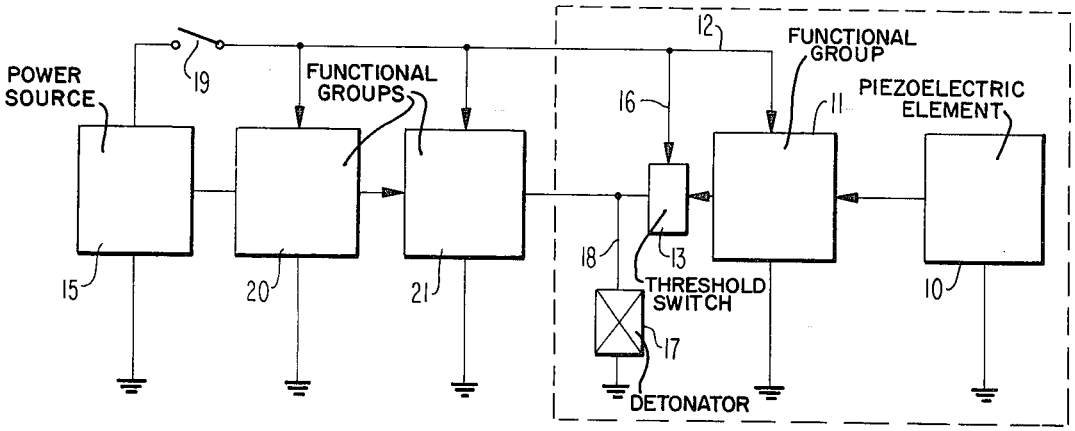
FIG. 1 shows the block circuit diagram of a fuze.

Referring now to the drawings wherein like reference numerals are utilized to designate like parts throughout the several views, there is shown in FIG. 1 a piezoelectric element 10 consisting of a piezo crystal and/or a piezoelectric pellet, one electrode of which is connected to the mass of the fuze housing, while the other electrode is connected to a first functional group 11. The first functional group 11 is a delay member which converts a direct voltage suddenly applied via line 12 into a gradually rising voltage which reaches the final value only after a delay or which provides an output value after a predetermined delay. The output voltage of the piezoelectric element 10 is superimposed on this voltage. The output of the first functional group 11 is connected to the control input of the trigger or threshold value switch member 13. When the value of the voltage at the control input 14 of the trigger member 13 exceeds the switching threshold, the trigger member connects the line 16 from the current source 15 to the line 18 leading to the electric detonator 17, so that the latter is ignited. One of the two terminals of the detonator 17 is connected to the mass or ground. The contactor 19 determines the actuation of the first functional group and thus the beginning of the voltage rise at its output. This contactor is arranged directly behind the current source 15 and is connected to line 12. The contactor 19 is closed automatically, for example upon firing of the projectile from the barrel.

Furthermore, two additional functional groups 20 and 21 are connected to the current source 15 which groups affect the time of ignition. The functional group 20 serves to provide safety of the projectile immediately after leaving the barrel, and the functional group 21 serves to provide penetration delay. Both functional groups 20, 21 are timing members which prevent, during certain time periods, the triggering of the ignition, for example, by connecting the line 18 of the electric detonator 17 to ground or by preventing the activation of the functional group 11.

Figure 2:
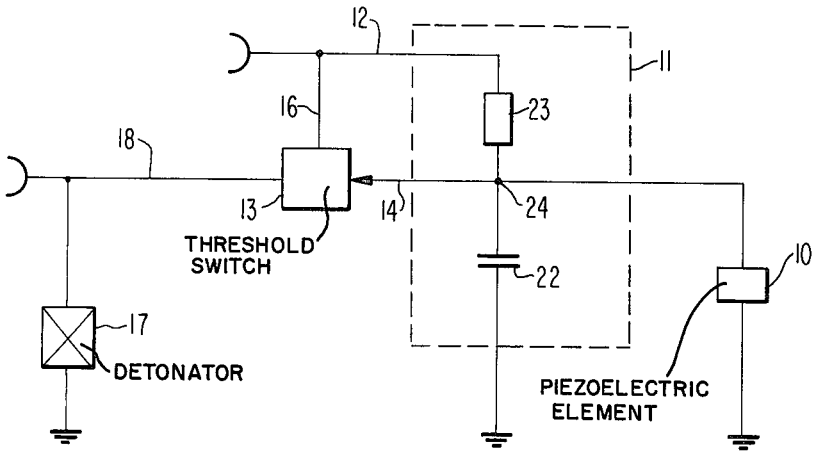
FIG. 2 shows a circuit diagram of the group of components surrounded by dashed lines in FIG. 1.

FIG. 2 shows the circuitry of an embodiment of the first functional group 11 wherein a gradually increasing output signal is provided without delay. This group consists of an RC member, the capacitor 22 of which is charged via the resistor 23, connected to line 12, as soon as the contactor 19 is closed. The junction point 24 of resistor 23 and capacitor 22 is connected, on the one hand, to the piezoelectric element 10 and, on the other hand, to the control input 14 of the trigger or threshold switch member 13.

When a projectile is fired from the barrel, the contactor 19 is closed. Thereby, a voltage is gradually built up at the capacitor 22 which initially is not charged. This voltage asymptotically approaches the full final value of the voltage provided by the current source 15. The curve of the voltage buildup at point 24 is denoted by 25 in FIG. 3. The instant of closing of the contactor 19 is assumed to be $t_0$.

If the projectile impinges on a target at instant $t_1$, the curve 26, as illustrated at the bottom of FIG. 3, is obtained for the mechanical deformation wave at the piezo crystal, having the form of an attentuated sinusoidal function. This deformation wave, passing through the piezoelectric element 10 at the speed of sound characteristic for the material, generates, with a delay, a corresponding alternating voltage pulse which begins at instant $t_2$ and is superimposed on the voltage 25 at the capacitor 22, so that the total voltage 27 results. If this total voltage exceeds th switching threshold 28 of the trigger switch member 13, the line 16 is connected to line 18 and thus ignition is initiated. In other words, whether an ingnition takes place depends, in addition to being dependent on the amplitude of the voltage produced at the piezoelectric element 10, on the respective amplitude of the voltage 25, and thus on the instant $t_2$ and/or $t_1$ at which the impact takes place.

If the projectile does not impact, the voltage 25 continues to rise until it reaches the threshold voltage 28 and effects the connection at the trigger switch member 13 without the support of a piezoelectrically generated voltage. Thus, the projectile disintegrates or self-destructs after the elapse of time $t_3$.

FIG. 4 shows the structural arrangement of a detonator head 30 in a longitudinal sectional view. The detonator head 30 consists of two parts, with a case 31 tapering to a tip at the front, and an associated tip 32 in which the piezoelectric pellet 10 is inserted. The latter rests, via a counter electrode, not shown, on the wall 33 at the rear. The counter electrode is electrically conductively connected to the functional groups housed in the space 34 of the case 31 and with electric and electronic components. Toward the rear, the member 35 follows the case 31 as the second part of head 30. This member 35 contains, in a recess 36, the energy supply in the form of the current source 15, e.g. an electric battery. The case 31 is threadedly connected with member 35. Both parts are provided with a corresponding thread for this purpose. The electric detonator 17 is provided in a bore 37 which starts at the space 36 and leads toward the rear. The bore 37 is followed by the detonator safety device 38, which is pivotable, for example, and finally by the booster 39. The detonator head 30 which is threadedly joined to the projectile at the front forms the tip of the projectile, the frontmost part of which is the piezoelectric pellet in the tip 32. However, the piezoelectric pellet can also be arranged in the interior of the detonator head 30, for example in the space 34. In this case, the impact effective on the tip of the projectile must be transmitted to the piezoelectric pellet via an anvil or a rod and the pellet must be fixedly supported at its backside.

The trigger switch member 13 is preferably fashioned as an integrated component, the equivalent circuit diagram of the trigger switch member being illustrated in FIG. 5. The anode-cathode path (load section) 40, 41 is formed by a thyristor 42 in series with a diode 43. A diode 44, operated in the blocking direction, is connected to the control electrode 14 of the thyristor. When the natural breakdown voltage, lying between 6.8 and 7.1 volts, is exceeded, the diode 44 becomes conductive and initiates the thyristor 42. The diode 43 serves for protection against so-called overhead actuation or triggering. Such overhead actuation occurs if there are very steep voltage rise conditions between anode and cathode. As shown, the line 16 is connected at 40 and the line 18 at 41.

The present invention makes it possible to produce fuzes with different ignition characteristics, depending on the requirements of each individual case; to provide safety against unintended actuation; and to avoid the defect of ignition failure.

While we have shown and described several constructions in accordance with the present invention, it is understood that the same is not limited thereto but is susceptible of numerous changes and modifications as known to a person skilled in the art, and we therefore do not wish to be limited to the details shown and described herein but intend to cover all such changes and modifications as are obvious to one of ordinary skill in the art.

What is claimed is:

1. A piezoelectric fuze, especially for projectiles, comprising power source means, detonator means, threshold switch means having a threshold value, piezoelectric element means for converting the mechanical shock wave produced upon impingement of the fuze onto a target into an electrical output signal for at least aiding in overcoming the threshold value of the threshold switch means, and at least a first control means for controlling the ignition of said detonator means, said first control means providing an electrical output signal for overcoming the threshold value of the threshold switch means, said threshold switch means being responsive to the output signals of said piezoelectric means and said first control means for establishing a connection between said power source means and said detonator means for igniting said detonator means when the threshold value thereof is exceeded.

2. A fuze according to claim 1, further comprising a detonator head member for attachment at the forward end of the projectile, said piezoelectric element means being secured at the tip of said detonator head member, said at least first control means and said threshold switch means having the electrical components thereof positioned in said detonator head member, said detonator head member being provided with a wall portion separating said piezoelectric element means from said electrical components of said at least first control means and said threshold switch means.

3. A fuze according to claim 2, wherein said power source means is positioned in said detonator head member rearwardly of said electrical components of said at least first control means and said threshold switch means.

4. A piezoelectric fuze, especially for projectiles, comprising power source means, detonator means, piezoelectric element means for converting the mechanical shock wave produced upon impingement of the fuze onto a target into an electrical output signal, threshold switch means, and at least a first control means for controlling the ignition of said detonator means, said first control means providing an electrical output signal, said threshold switch means being responsive to the output signals of said piezoelectric means and said first control means for establishing a connection between said power source means and said detonator means for igniting said detonator means when the threshold value thereof is exceeded, the threshold value of said threshold switch means being above the maximum output signal of said piezoelectric element means.

5. A fuze according to claim 4, wherein said first control means provides an output signal which is superimposed on the output signal of said piezoelectric element means to provide a superimposed signal having a total value for exceeding the threshold value of said threshold switch means.

6. A fuze according to claim 5, wherein said first control means provides an output signal having a value which increases in accordance with time.

7. A fuze according to claim 3, wherein said first control means provides an output signal after a predetermined delay.

8. A fuze according to claim 5, wherein said threshold switch means is provided with a control input and said piezoelectric element means and said first control means have the outputs thereof connected to the control input of said threshold switch means.

9. A fuze according to claim 8, wherein said first control means comprises an RC circuit having the output thereof connected to the output of said piezoelectric element means and the control input of said threshold switch means.

10. A fuze according to claim 5, wherein said first control means provides an output signal which increases in value and which attains the threshold value of said threshold switch means after a predetermined delay period so as to insure ignition of said detonator means after the predetermined delay period has elapsed.

11. A fuze according to claim 4, further comprising firing switch means responsive to the firing of the projectile for establishing a connection between said power source means and said at least first control means.

12. A fuze according to claim 11, wherein said firing switch means also establishes a connection between said power source means and said threshold switch means.

13. A fuze according to claim 12, further comprising at least a second control means for controlling the ignition of said detonator means predetermined time intervals, said firing switch means also establishing a connection between said power source means and said at least second control means.

14. A fuze according to claim 10, wherein said threshold switch means is provided with a control input and said piezoelectric element means and said first control means have the outputs thereof connected to the control input of said threshold switch means.

15. A fuze according to claim 14, wherein said threshold switch means includes a thyristor having a control electrode and a diode connected to the control electrode in the blocking direction thereof, said diode and said control electrode forming said control input of said threshold switch means.

16. A fuze according to claim 15, further comprising firing switch means responsive to the firing of the projectile for establishing a connection between said power source means and said at least first control means.

17. A fuze according to claim 16, wherein said firing switch means also establishes a connection between said power source means and said threshold switch means.

18. A fuze according to claim 17, further comprising at least a second control means for controlling the ignition of said detonator means during predetermined time intervals, said firing switch means also establishing a connection between said power source means and said at least second control means.

19. A fuze accordiing to claim 13, further comprising a detonator head member for attachment at the forward end of the projectile, said piezoelectric element means being secured at the tip of said detonator head member, said at least first control means and said threshold switch means having the electrical components thereof positioned in said detonator head member, said detonator head member being provided with a wall portion separating said piezoelectric element means from said electrical components of said control means and said threshold switch means.

20. A fuze according to claim 19, wherein said power source means is positioned in said detonator head member rearwardly of said electrical components of said control means and said threshold switch means.

21. A piezoelectric fuze especially for projectiles, comprising power source means, detonator means, piezoelectric element means for converting the mechanical shock wave produced upon impingement of the fuze onto a target into an electrical output signal, threshold switch means, and at least a first control means for controlling the ignition of said detonator means, said first control means providing an electrical output signal, said threshold switch means being responsive to the output signals of said piezoelectric means and said first control means for establishing a connection between said power source means and said detonator means for igniting said detonator means when the threshold value thereof is exceeded, said first control means being arranged for providing an output signal having at least a final value which exceeds the threshold value of said threshold switch means.

22. A fuze according to claim 21 wherein said first control means provides an output signal of varying value with at least the final value being sufficient to exceed the threshold value of said threshold switch means independently of the value of the output signal of said piezoelectric means.

* * * * *